US009293829B2

(12) United States Patent
Kim et al.

(10) Patent No.: US 9,293,829 B2
(45) Date of Patent: Mar. 22, 2016

(54) ANTENNA DEVICE AND ELECTRONIC DEVICE INCLUDING THE ANTENNA DEVICE

(71) Applicant: Samsung Electronics Co., Ltd., Gyeonggi-do (KR)

(72) Inventors: Do-Won Kim, Gyeonggi-do (KR); Jae-Jin Lee, Daejeon (KR); Shin-Hee Cho, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 261 days.

(21) Appl. No.: 14/154,791

(22) Filed: Jan. 14, 2014

(65) Prior Publication Data

US 2014/0292595 A1 Oct. 2, 2014

(30) Foreign Application Priority Data

Mar. 29, 2013 (KR) ..... 10-2013-0034192

(51) Int. Cl.
*H01Q 9/04* (2006.01)
*H01Q 21/28* (2006.01)

(52) U.S. Cl.
CPC ..... *H01Q 9/045* (2013.01); *H01Q 21/28* (2013.01)

(58) Field of Classification Search
CPC ... H01Q 9/0407; H01Q 9/0421; H01Q 9/045; H01Q 9/0435; H01Q 9/0457; H01Q 3/247; H01Q 5/35; H01Q 25/04; H04B 7/028–7/10
See application file for complete search history.

(56) References Cited

U.S. PATENT DOCUMENTS 4,071,846 A * 1/1978 Oltman, Jr. ..... H01Q 21/062 343/700 MS
4,151,530 A * 4/1979 Kaloi ..... H01Q 9/0407 343/700 MS
5,969,681 A * 10/1999 O'Neill, Jr. ..... H01Q 9/0428 343/700 MS
6,483,463 B2 * 11/2002 Kadambi ..... H01Q 9/0421 343/700 MS
6,590,545 B2 * 7/2003 McCorkle ..... H01Q 9/40 343/700 MS
6,914,563 B2 * 7/2005 Chen ..... H01Q 13/10 343/700 MS
7,253,779 B2 8/2007 Greer et al.
7,994,985 B2 * 8/2011 Luk ..... H01Q 9/0435 343/700 MS
8,044,874 B2 * 10/2011 Parsche ..... H01Q 9/0435 343/767

(Continued)

FOREIGN PATENT DOCUMENTS

KR 1020100019778 2/2010

OTHER PUBLICATIONS

Oikonomopoulos-Zachos, Christos, et al., A 3-Port Antenna for MIMO applications, pp. 4.

(Continued)

*Primary Examiner* — Robert Karacsony
*Assistant Examiner* — Patrick Holecek
(74) *Attorney, Agent, or Firm* — The Farrell Law Firm, P.C.

(57) ABSTRACT

An antenna device and an electronic device including the antenna device are provided. The antenna device includes a radiation patch in a shape of a flat plate, a first feed point configured in a side region of the radiation patch, and a second feed point configured in another side region of the radiation patch. The first feed point and the second feed point are a same distance from a virtual ground plane formed on the radiation patch, out-of-phase feeding is provided to the first feed point and the second feed point to form a broadside radiation pattern, and in-phase feeding is provided to the first feed point and the second feed point to form an endfire radiation pattern.

18 Claims, 11 Drawing Sheets

(56) References Cited

U.S. PATENT DOCUMENTS

| | | | | |
|---|---|---|---|---|
| 8,072,291 | B2 * | 12/2011 | Itoh | H01P 5/222 333/118 |
| 2009/0295645 | A1 * | 12/2009 | Campero | H01Q 9/0407 343/700 MS |
| 2010/0197261 | A1 * | 8/2010 | Zibrik | H04B 7/0871 455/232.1 |
| 2012/0188917 | A1 * | 7/2012 | Knox | H01Q 1/2225 370/277 |
| 2013/0278467 | A1 * | 10/2013 | Dassano | H01Q 1/2241 343/700 MS |
| 2014/0097995 | A1 * | 4/2014 | McKinzie, III | H01Q 9/0407 343/793 |

OTHER PUBLICATIONS

Rajo-Iglesias, Eva, et al., Compact Multimode Patch Antennas for MIMO Applications, IEEE Antennas and Propagation Magazine, vol. 50, No. 2, Apr. 2008, pp. 197-205.

* cited by examiner

ANTENNA DEVICE AND ELECTRONIC DEVICE INCLUDING THE ANTENNA DEVICE

PRIORITY

This application claims priority under 35 U.S.C. §119(a) to a Korean Patent Application filed in the Korean Intellectual Property Office on Mar. 29, 2013 and assigned Serial No. 10-2013-0034192, the content of which is incorporated herein by reference.

BACKGROUND OF THE INVENTION

1. Field of the Invention

The present invention relates generally to an electronic device, and more particularly, to an electronic device including an antenna device that provides a wireless transmission/reception function.

2. Description of the Related Art

With the proliferation of multimedia services based on mobile communication services, a need for ultra-high speed and voluminous communication is increasing. Ultra-high speed and voluminous transmission techniques are also needed for data delivery between circuits and between modules inside an electronic device as well as in communication between a base station and an electronic device and between electronic devices. For example, to play high-definition moving images, ultra-high speed and voluminous data transmission is required between a codec-mounted chip and a display module. However, up to date, a transmission line provided between a chip and a display module inside an electronic device is a wired transmission line, which limits the expansion of transmission speed and capacity. With a wired data transmission line, the number of signal lines increases with the expansion of transmission speed and capacity; but in an electronic device designed to be portable, such as a mobile communication terminal, it is difficult to secure enough space therein for installing an expanded, wired transmission line.

Hence, studies have been actively conducted to implement ultra-high speed and voluminous transmission techniques in small spaces, such as inside an electronic device, as well as for wireless communication, by establishing a wireless-type transmission line. For example, a Multiple Input Multiple Output (MIMO) antenna device may implement ultra-high speed and voluminous transmission by using a pattern diversity function.

A technique for implementing a pattern diversity function is described in U.S. Pat. No. 7,253,779 B2 (Aug. 7, 2007). In this U.S. patent, two radiators of different types are disposed or two radiators of the same type are disposed in different directions to obtain a broadside radiation pattern and an endfire radiation pattern.

Another technique for implementing the pattern diversity function is introduced in a paper released in INICA'07 (2007), entitled "A 3-Port Antenna for MIMO Applications", in which a monopole antenna is disposed on a patch antenna. In this paper, the patch antenna implements a broadside radiation pattern and the monopole antenna implements an endfire radiation pattern.

Further, another technique for implementing the pattern diversity function is described in a paper released in IEEE Antennas and Propagation Magazine (2008), entitled "Compact Multimode Patch Antennas for MIMO Applications", in which two circular patch antennas having different sizes are disposed on and under a substrate. In this technique, one of the circular patch antennas implements a broadside radiation pattern and the other implements an endfire radiation pattern.

However, the foregoing conventional techniques for implementing the pattern diversity function need two or more antennas, i.e., two or more radiators, to implement different radiation patterns. As a result, a space or a thickness of a substrate for arranging an antenna device increases, and the antenna device becomes difficult to install in a small device. Moreover, as different radiators are used, depending on a desired pattern, fine tuning is required for the same frequency operation, which complicates design of the antenna device.

SUMMARY OF THE INVENTION

The present invention has been made to address at least the problems and disadvantages described above and to provide at least the advantages described below.

Accordingly, an aspect of the present invention is to provide an antenna device that implements a pattern diversity function while reducing an installation space and an electronic device including the antenna device.

Another aspect of the present invention is to provide an antenna device that implements broadside/endfire radiation patterns by steering a radiation pattern with one radiator and an electronic device including the antenna device.

Another aspect of the present invention is to provide an antenna device that implements a pattern diversity function while enabling easy design and an electronic device including the antenna device.

In accordance with an aspect of the present invention, an antenna device is provided including a radiation patch configured in a shape of a flat plate, a first feed point configured in a side region of the radiation patch, and a second feed point configured in the other side region of the radiation patch, in which the first feed point and the second feed point are in the same distance from a virtual ground plane formed on the radiation patch, and out-of-phase feeding is provided to the first feed point and the second feed point to form a broadside radiation pattern, and in-phase feeding is provided to the first feed point and the second feed point to form an endfire radiation pattern.

In accordance with another aspect of the present invention, an electronic device is provided including a configured first circuit board, a first antenna device configured on the first circuit board, a second circuit board configured to face the first circuit board, and a second antenna device configured on the second circuit board, in which at least the first antenna device includes a radiation patch in a shape of a flat plate, a first feed point provided in a side region of the radiation patch, and a second feed point provided in the other side region of the radiation patch, in which the first feed point and the second feed point are in the same distance from a virtual ground plane formed on the radiation patch, and out-of-phase feeding is provided to the first feed point and the second feed point to form a broadside radiation pattern, and in-phase feeding is provided to the first feed point and the second feed point to form an endfire radiation pattern.

BRIEF DESCRIPTION OF THE DRAWINGS

The above and other aspects, features and advantages of certain embodiments of the present invention will be more apparent from the following detailed description taken in conjunction with the accompanying drawings, in which.

Throughout the drawings, like reference numerals will be understood to refer to like parts, components, and structures.

DETAILED DESCRIPTION OF EMBODIMENTS OF THE PRESENT INVENTION

The following description with reference to the accompanying drawings is provided to assist in a comprehensive understanding of various embodiments of the present invention as defined by the claims and their equivalents. It includes various specific details to assist in that understanding but these are to be regarded merely as examples. Accordingly, those of ordinary skilled in the art will recognize that various changes and modifications of the embodiments described herein can be made without departing from the scope and spirit of the present invention. In addition, descriptions of well-known functions and constructions may be omitted for clarity and conciseness.

The terms and words used in the following description and claims are not limited to their dictionary meanings, but, are merely used by the inventor to enable a clear and consistent understanding of the present invention. Accordingly, it should be apparent to those skilled in the art that the following description of various embodiments of the present invention is provided for illustration purpose only and not for the purpose of limiting the present invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
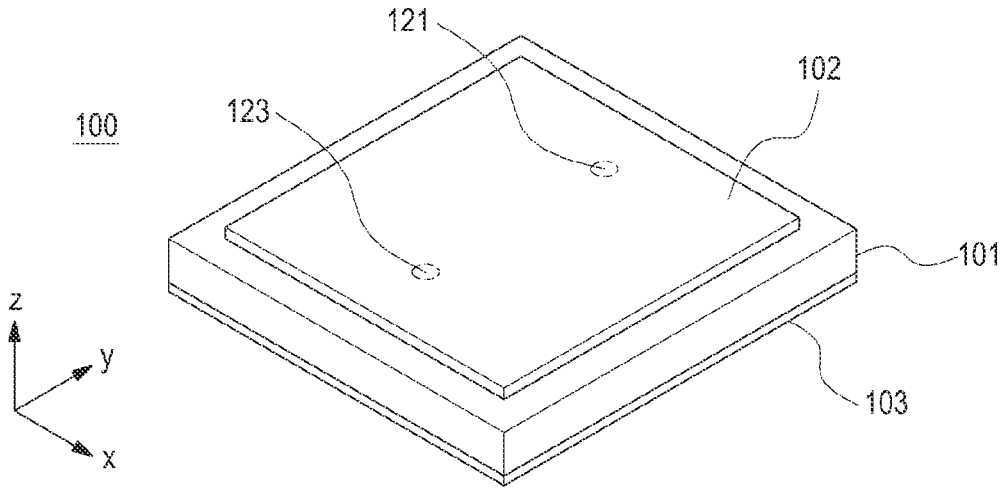
FIG. 1 illustrates an antenna device according to an embodiment of the present invention.

FIG. 1 illustrates an antenna device 100 according to an embodiment of the present invention.

Referring to FIG. 1, the antenna device 100 includes one radiation patch 102 and two feed points 121 and 123. A broadside radiation pattern or an endfire radiation pattern is formed according to a phase difference between feed signals provided to the feed points 121 and 123. Although the radiation patch 102 illustrated in FIG. 1 is attached to a dielectric substrate 101, the radiation patch 102 may be separate from the dielectric substrate 101. For example, if mounted in an electronic device, the radiation patch 102 may be attached to a separate carrier disposed on a main circuit board of the electronic device. The radiation patch 102 may be disposed apart from the dielectric substrate 101 through a separate support.

Figure 2:
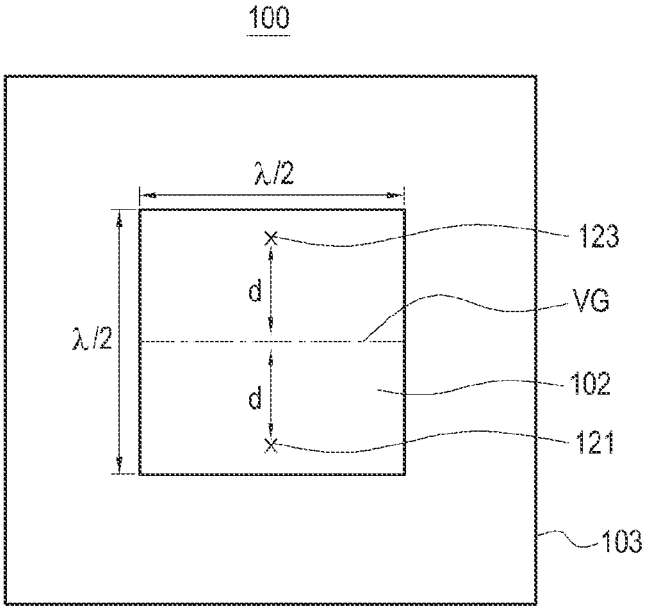
FIG. 2 illustrates a floor plane for a structure of an antenna device illustrated in FIG. 1 according to an embodiment of the present invention.
Figure 3:
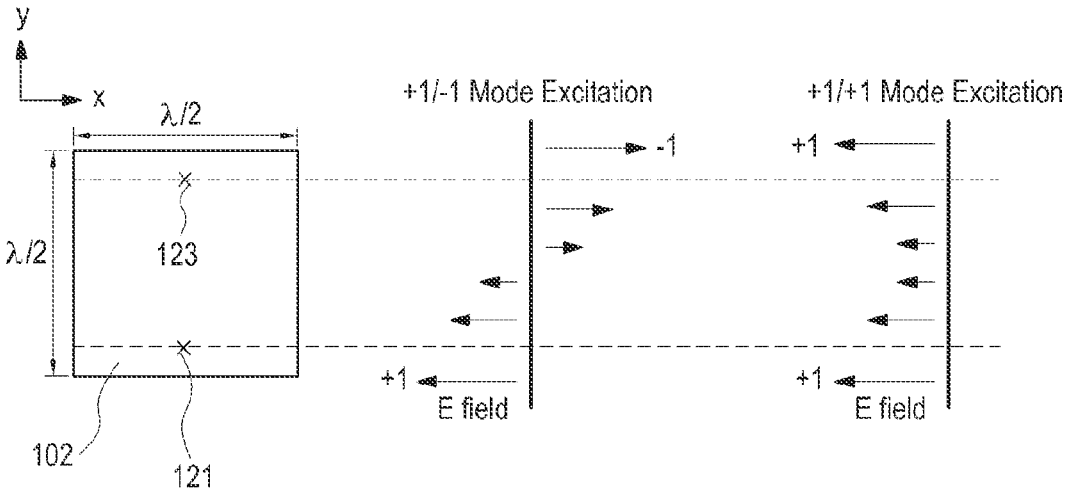
FIG. 3 illustrates a state in which a radiation patch of an antenna device illustrated in FIG. 1 is excited according to an embodiment of the present invention.
Figure 4:
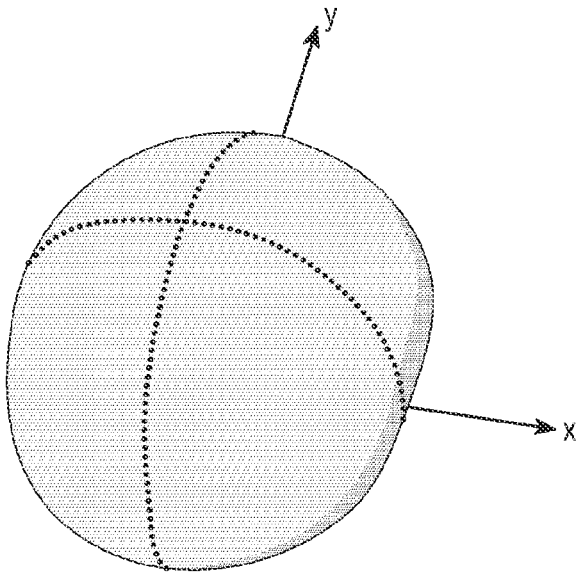
FIG. 4 illustrates a state in which an antenna device illustrated in FIG. 1 forms a broadside radiation pattern according to an embodiment of the present invention.
Figure 5:
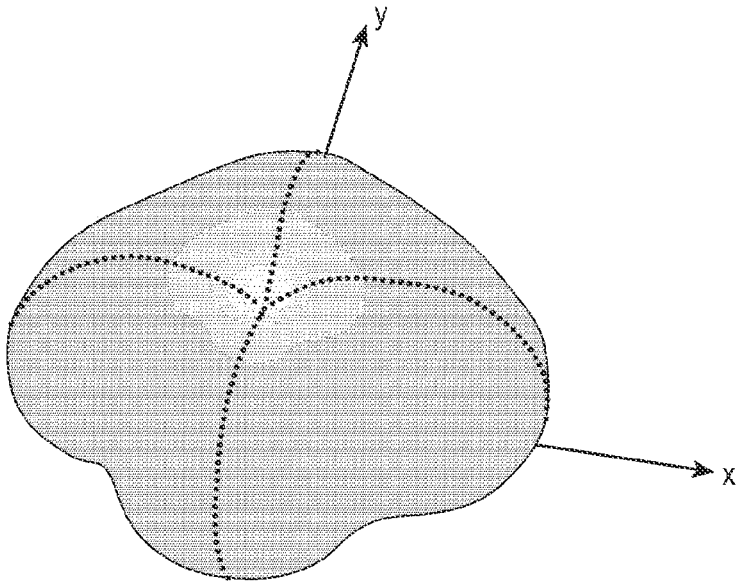
FIG. 5 illustrates a state in which an antenna device illustrated in FIG. 1 forms an endfire radiation pattern according to an embodiment of the present invention.

FIG. 2 illustrates a floor plan for a structure of the antenna device 100 illustrated in FIG. 1. FIG. 3 illustrates a state in which the radiation patch 102 of the antenna device 100 illustrated in FIG. 1 is excited. FIG. 4 illustrates a state in which an antenna device illustrated in FIG. 1 forms a broadside radiation pattern according to an embodiment of the present invention. FIG. 5 illustrates a state in which an antenna device illustrated in FIG. 1 forms an endfire radiation pattern according to an embodiment of the present invention. Hereinafter, a detailed structure of the antenna device 100 will be described with reference to FIGS. 1 through 5.

Referring to FIGS. 1 through 5, the antenna device 100 includes the radiation patch 102 in the shape of a flat plate and first and second feed points 121 and 123 provided in the radiation patch 102. Once out-of-phase feeding is provided to the first and second feed points 121 and 123, the antenna device 100 forms a broadside radiation pattern. If in-phase feeding to the first and second feed points 121 and 123 is performed, the antenna device 100 forms an endfire radiation pattern.

The radiation patch 102 is a quadrangle whose side is, in length, a half of a resonance frequency wavelength, $\lambda/2$, and in accordance with an embodiment of the present invention, the radiation patch 102 may be a circle having a diameter that is a half of a resonance frequency wavelength, $\lambda/2$. If the radiation patch 102 is a quadrangle, the radiation patch 102 may be designed or manufactured such that one side or two or more sides of the four sides may have a length of $\lambda/2$. In a detailed embodiment of the present invention, the radiation patch 102 is a square in which the length of one side is $\lambda/2$.

The first feed point 121 is disposed in a side region of the radiation patch 102, and the second feed point 123 is disposed in the other side region of the radiation patch 102. Once one of the first and second feed points 121 and 123 is disposed in one side of the radiation patch 102, the antenna device 100 forms a Virtual Ground (VG) plane traverses the radiation patch 102 by nature of the patch antenna device 100. It may be easily understood by those of ordinary skill in the art that the VG plane does not have a physical structure actually implemented on the radiation patch 102, but is formed by an electric phenomenon when the patch antenna device 100 is fed.

The first and second feed points 121 and 123 are generally the same distance d from the VG plane, for example, are symmetric to each other. Thus, when the first and second feed points 121 and 123 are disposed, a straight line (illustrated as L in FIG. 19) connecting the first feed point 121 with the second feed point 123 may also be inclined with respect to the VG plane. The first and second feed points 121 and 123 may be disposed to have the same distance d measured perpendicular to the VG plane. If the line L connecting the first feed point 121 with the second feed point 123 is perpendicular to the VG plane, the first feed point 121 and the second feed point 123 are disposed symmetrically to each other on the radiation patch 102. As will be described with reference to FIGS. 19 and 20, each of the first feed point 121 and the second feed point 123 may be at a position offset from the center line of the radiation patch 102, that is, at one of the quadrants of the radiation patch 102.

The antenna device 100 includes the dielectric substrate 101, on a surface of which the radiation patch 102 is disposed. The dielectric substrate 10 may have a multi-layer structure and include at least one ground plane 103. In this case, the antenna device 100 may further include a connection member (illustrated as 127 in FIG. 11) that connects the radiation patch 102 to the ground plane 103. With the connection member 127, the antenna device 103 may adjust a direction of the endfire radiation pattern (or steer the endfire radiation), which will be described in detail with reference to FIG. 11.

The antenna device 100 adjusts the distance d between the VG plane and the first and second feed points 121 and 123 to implement impedance match. A general patch antenna includes one feed point and forms a broadside radiation pattern, but the antenna device 100 may form an endfire radiation pattern and a broadside radiation pattern according to feeding provided to the first and second feed points 121 and 123.

In FIG. 3, '+1/−1 Mode Excitation' indicates a state in which the radiation patch 102 is excited when 180° out-of-phase feeding to the first feed point 121 and the second feed point 123 is performed. The antenna device 100 forms a broadside radiation pattern, which is illustrated in FIG. 4.

In FIG. 3, '+1/+1 Mode Excitation' indicates a state in which the radiation patch 102 is excited when in-phase feeding to the first feed point 121 and the second feed point 123 is performed. The antenna device 100 forms an endfire radiation pattern having a null in a central portion of the radiation patch 102, which is illustrated in FIG. 5.

When the antenna device 100 forms a radiation pattern in a particular direction, isolation in the other direction may be superior. Thus, the antenna device 100 is installed in a small space such as an electronic device and a wireless transmission line may be easily formed between chips and between circuit boards, which will be described in detail with reference to FIGS. 15 to 18. The antenna device 100 forms a transmission line in the electronic device and is also used to provide wireless communication between electronic devices, between an electronic device and a base station, or between relay stations.

Figure 6:
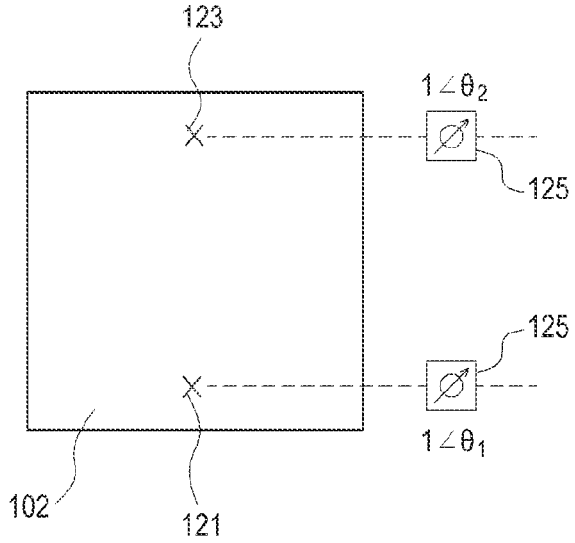
FIG. 6 illustrates a structure in which a phase shifter is coupled to an antenna device illustrated in FIG. 1 according to an embodiment of the present invention.

The antenna device 100 adjusts a phase difference between feed signals provided to the first feed point 121 and the second feed point 123 to steer a broadside radiation pattern. Referring to FIG. 6, to adjust a phase difference between the feed signals provided to the first feed point 121 and the second feed point 123, the antenna device 100 further include a pair of phase shifters 125. The phase shifters 125 are connected to the first feed point 121 and the second feed point 123, respectively.

FIGS. 7 through 10 illustrate a broadside radiation pattern when out-of-phase feeding is provided to the first and second feed points 121 and 123. In FIGS. 7 through 10, a represents an angular direction measured from a z-axis illustrated in FIG. 1.

Figure 7:
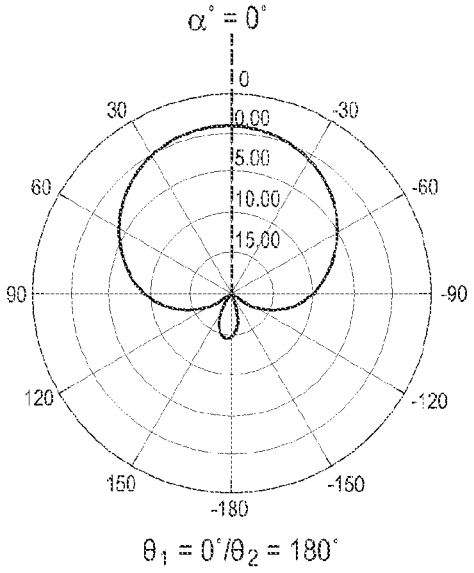
FIGS. 7 through 10 illustrate an operation of an antenna device illustrated in FIG. 6 according to an embodiment of the present invention.

FIG. 7 illustrates a broadside radiation pattern when feed signals having a phase difference of about 180° are provided to the first feed point 121 and the second feed point 123.

Referring to FIG. 7, when the feed signals provided to the first feed point 121 and the second feed point 123 have a phase difference of about 180°, the broadside radiation pattern shows a maximum output in a broadside direction, that is, the z-axis direction.

Figure 8:
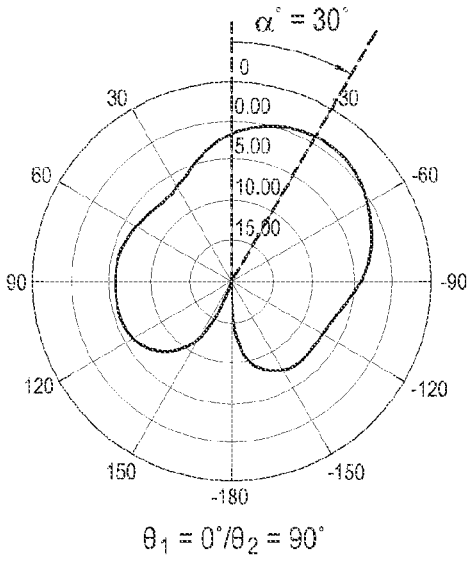

FIG. 8 illustrates a broadside radiation pattern when feed signals having a phase difference of about 90° are provided to the first feed point 121 and the second feed point 123. The broadside radiation pattern of the antenna device 100 shows a maximum output in an about +30° direction.

Figure 9:
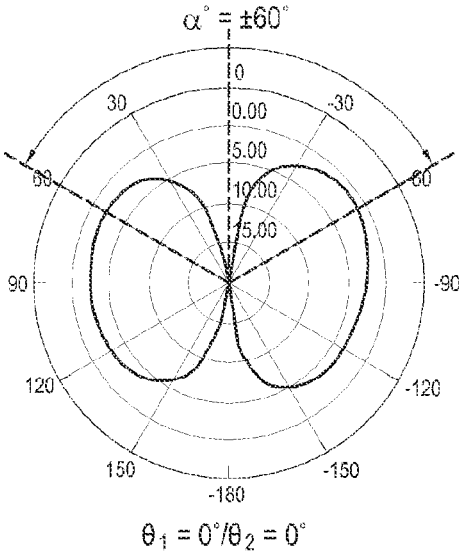

FIG. 9 illustrates a radiation pattern when in-phase feeding is provided to the first feed point 121 and the second feed point 123. When in-phase feeding is provided to the first feed point 121 and the second feed point 123, the antenna device 100 forms the broadside radiation pattern. In FIG. 9, when in-phase feeding is provided to the first feed point 121 and the second feed point 123, no output appears in the broadside direction, i.e., the z-axis direction, and a maximum output appears in a ±60° direction.

Figure 10:
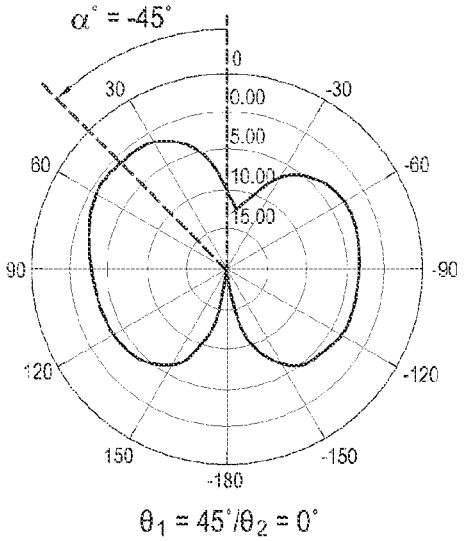

FIG. 10 illustrates a broadside radiation pattern when feed signals having a phase difference about 45° are provided to the first feed point 121 and the second feed point 123.

Referring to FIG. 10, the broadside radiation pattern of the antenna device 100 shows a maximum output in an about −45° direction.

As such, the antenna device 100 steers the broadside radiation pattern by adjusting a phase difference between the feed signals provided to the first feed point 121 and the second feed point 123.

According to various embodiments of the present invention, the antenna device 100 may steer an endfire radiation pattern by using the connection member 127. The connection member 127 connects the radiation patch 102 to the ground plane 103. If the radiation patch 102 is attached to the dielectric substrate 101, the connection member 127 may be disposed to pass through the dielectric substrate 101. For example, a via-hole may be formed in the dielectric substrate 101 to implement a function of the connection member 127. The connection member 127 may be formed by fitting a metallic rod of a conductive material, such as copper or gold, into the via-hole formed in the dielectric substrate 101. If the radiation patch 102 is placed apart from the dielectric substrate 101, the connection member 127 may be a metallic rod that extends from the radiation patch 102 to connect to the ground plane 103.

Figure 11:
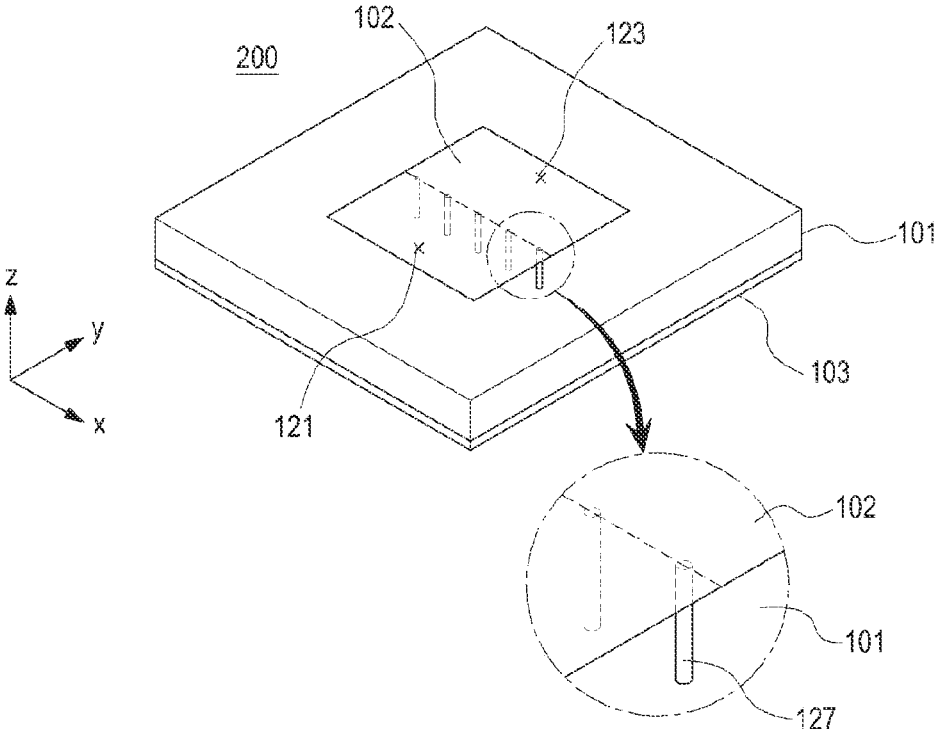
FIG. 11 illustrates a state in which a connection member is provided in an antenna device illustrated in FIG. 1 according to an embodiment of the present invention.
Figure 13:
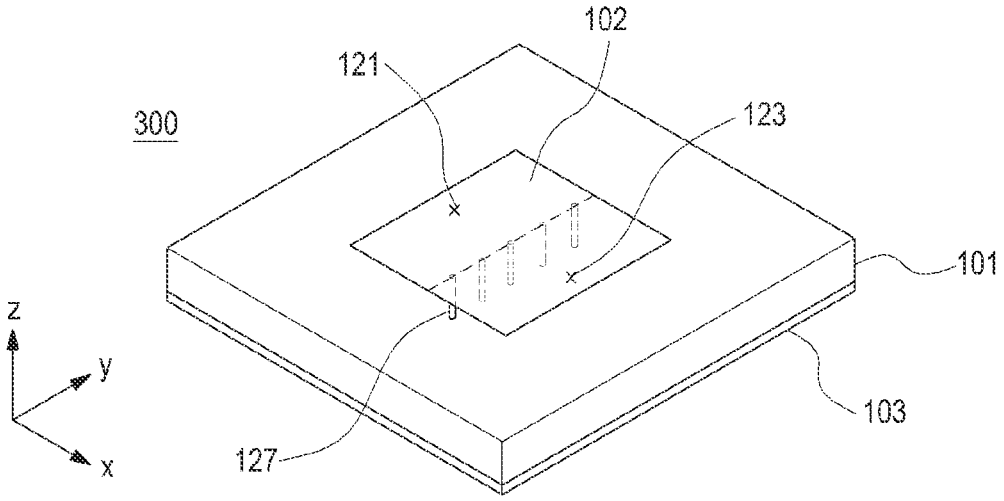
FIG. 13 illustrates a modified example of an antenna device illustrated in FIG. 11 according to an embodiment of the present invention.

Antenna devices 200 and 300 illustrated in FIGS. 11 and 13, respectively, further include a plurality of connection members 127 in addition to the above-described structure of the antenna device 100. The plurality of connection members 127 may be arranged on the VG plane or arranged adjacent to the VG plane.

Figure 12:
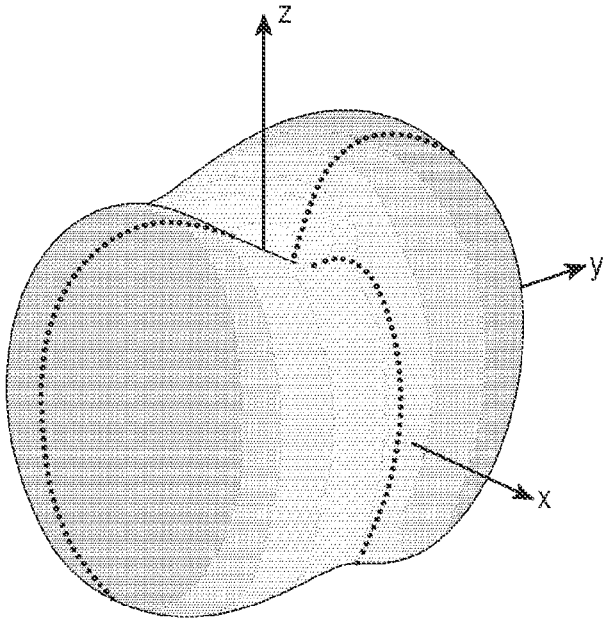
FIG. 12 illustrates an operation of an antenna device illustrated in FIG. 11 according to an embodiment of the present invention.

FIG. 11 illustrates a structure in which the plurality of connection members 127 are arranged in the x-axis direction, and FIG. 12 illustrates a radiation pattern formed when in-phase feeding is performed with respect to the antenna device 200 illustrated in FIG. 11. If in-phase feeding is provided to the first feed point 121 and the second feed point 123 in the antenna device 200 illustrated in FIG. 11, the VG plane is formed in the x-axis direction as illustrated in FIG. 12, such that a pattern of endfire radiation in ±y-axis directions is formed.

Figure 14:
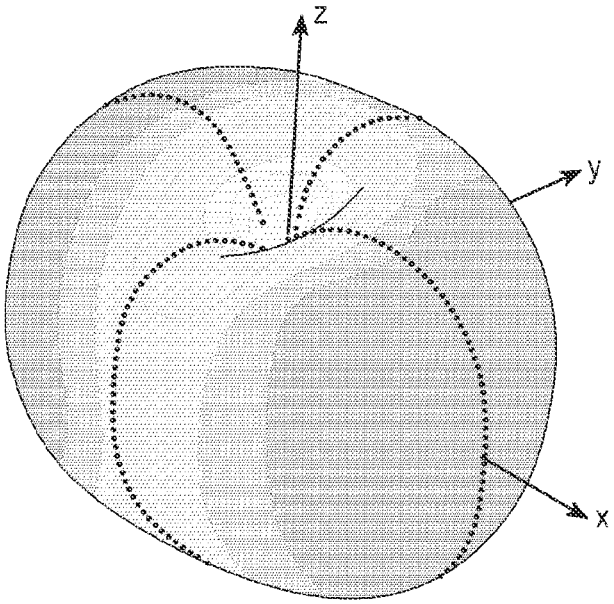
FIG. 14 illustrates an operation of an antenna device illustrated in FIG. 13 according to an embodiment of the present invention.

FIG. 13 illustrates a plurality of connection members 127 arranged in the y-axis direction, and FIG. 14 illustrates a radiation pattern formed when in-phase feeding is performed with respect to the antenna device 300 illustrated in FIG. 13. Once in-phase feeding is performed with respect to the first feed point 121 and the second feed point 123 in the antenna device 300 illustrated in FIG. 13, the VG plane is formed in the y-axis direction as illustrated in FIG. 14, such that a pattern of endfire radiation in ±x-axis directions is formed.

As such, depending on the arrangement of the connection member 127, the antenna device according to various embodiments of the present invention may steer the endfire radiation pattern. The number and positions of connection members 127 arranged on the antenna devices 200 and 300 may vary with design of an electronic device on which the antenna devices 200 and 300 are to be mounted.

Figure 15:
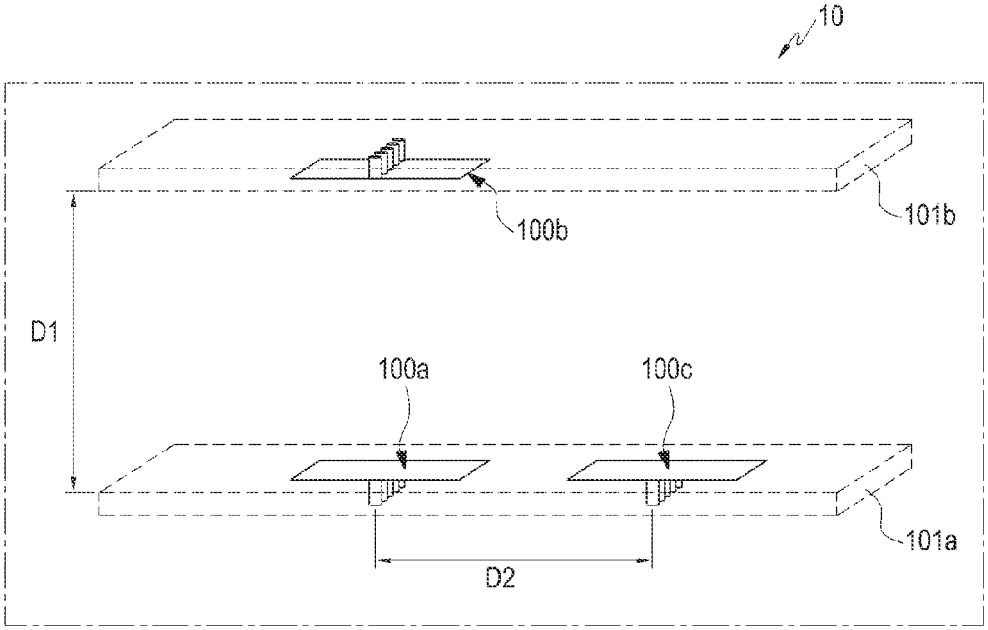
FIG. 15 is a schematic diagram illustrating a structure of an electronic device including an antenna device illustrated in FIG. 1 according to an embodiment of the present invention.
Figure 16:
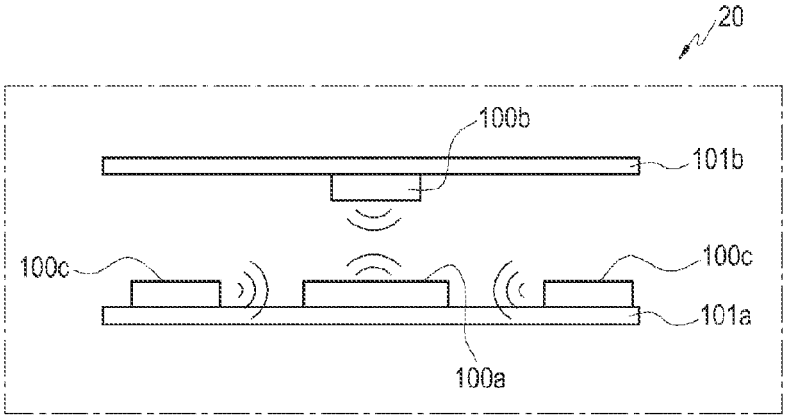
FIG. 16 illustrates a modified example of an electronic device illustrated in FIG. 15 according to an embodiment of the present invention.

FIGS. 15 and 16 illustrate electronic devices 10 and 20 including an antenna device according to various embodiments of the present invention. Specifically, in FIGS. 15 and 16, first through third antenna devices 100*a*, 100*b*, and 100*c* communicate with one another in the electronic devices 10 and 20. However, the antenna device according to various embodiments of the present invention may also be used for communication between an electronic device and a mobile communication base station, communication between electronic devices, and communication between a relay station, such as a wireless router, and an electronic device.

As illustrated in FIGS. 15 and 16, the electronic devices 10 and 20 include a first circuit board 101*a* and a second circuit board 101*b*. The first circuit board 101*a* may be used as, for example, main circuit boards of the electronic devices 10 and 20, and the second circuit board 101*b* may be used as, for example, circuit boards provided in input/output modules of the electronic devices 10 and 20. Transmission of a relatively small amount of data, such as audio or data of a physical keypad, may be implemented generally in a wired manner. However, outputting or capturing high-definition video is accompanied by transmission of voluminous data, and an ultra-high speed and large-capacity transmission line enabling such an operation should be used. Accordingly, the antenna devices 100*a*, 100*b*, and 100*c* may provide an ultra-high speed and large-capacity transmission line and even a wireless transmission line, and thus are easy to be installed in a device that provides a limited space, like a mobile communication terminal.

The antenna devices 100*a*, 100*b*, and 100*c*, more specifically, radiation patches thereof, are disposed on the first circuit board 101*a* and the second circuit board 101*b* of each of the electronic devices 10 and 20, and the second circuit board 101*b* is provided on a touch screen display panel. The first antenna device 100*a* provided on the first circuit board 101*a* may have the structure of the antenna device 100 as illustrated in FIG. 1. That is, the first antenna device 100*a* forms one of a broadside radiation pattern and an endfire radiation pattern, depending on a phase difference between feed signals provided to the first feed point 121 and the second feed point 123.

The second antenna device 100*b* is provided on the second circuit board 101*b*. The second antenna device 100*b* is disposed to face the first antenna device 100*a*.

Among the antenna devices 100*a*, 100*b*, and 100*c*, the third antenna device 100*c* is disposed adjacent to the first antenna device 100*a* in the first circuit board 101*a*; and as illustrated in FIG. 16, a plurality of third antenna devices 100*c* may be provided on the first circuit board 101*a*.

The first through third antenna devices 100*a*, 100*b*, and 100*c* transmit and receive data in the electronic devices 10 and 20, and at the same time, provide an ultra-high speed and large-capacity wireless transmission line. The second and third antenna devices 100*b* and 100*c* may also be manufactured to have the structure of the antenna device 100 illustrated in FIG. 1. However, if the second antenna device 100*b* performs wireless transmission and reception with the first antenna device 100*a*, the second antenna device 100*b* may be manufactured to have a general patch antenna structure. If the third antenna device 100*c* performs wireless transmission and reception with the first antenna device 100*a*, the third antenna device 100*c* may be manufactured to have a general monopole antenna structure.

When the electronic devices 10 and 20, as described above, process voluminous data such as high-definition video, the first through third antenna devices 100*a*, 100*b*, and 100*c* operate as will be described below.

First, the third antenna device 100*c* is connected to a codec-mounted chip and wirelessly transmits a signal output from the chip to the first antenna device 100*a*. In this case, the first antenna device 100*a* may be set to a state in which transmission and reception in the endfire direction are possible.

The first antenna device 100*a* delivers a signal received from the third antenna device 100*c* to the second antenna device 100*b*, and in this case, the first antenna device 100*a* may be set to a state in which transmission and reception in a broadside direction are possible. The second antenna device 100*b* delivers a signal received from the first antenna device 100*a* to the second circuit board 101*b*, more specifically, to the touch screen display panel, such that the touch screen display panel may output high-definition video.

The first antenna device 100*a* may be directly connected to the chip through a line for transmitting data related to the video. In this case, the third antenna device 100*c* may not be needed. However, if the second circuit board 100*b* has both a function of an output device and a function of an input device, like the touch screen display panel, the first antenna device 100*a* may separately transmit and receive an input signal and an output signal. In this case, as illustrated in FIG. 16, the plurality of third antenna devices 100*c* may be disposed, such that one of them may be connected to an input/output controller provided on the first circuit board 101*a* and another one of them may be connected to the codec-mounted chip.

When transmission and reception are performed among a plurality of antenna devices in a small space, isolation may be used. More specifically, during transmission and reception between the first antenna device 100*a* and the second antenna device 100*b*, the third antenna device 100*c* is maintained in an isolated state, and during transmission and reception between the first antenna device 100*a* and the third antenna device 100*c*, the second antenna device 100*b* are maintained in an isolated state.

Figure 17:
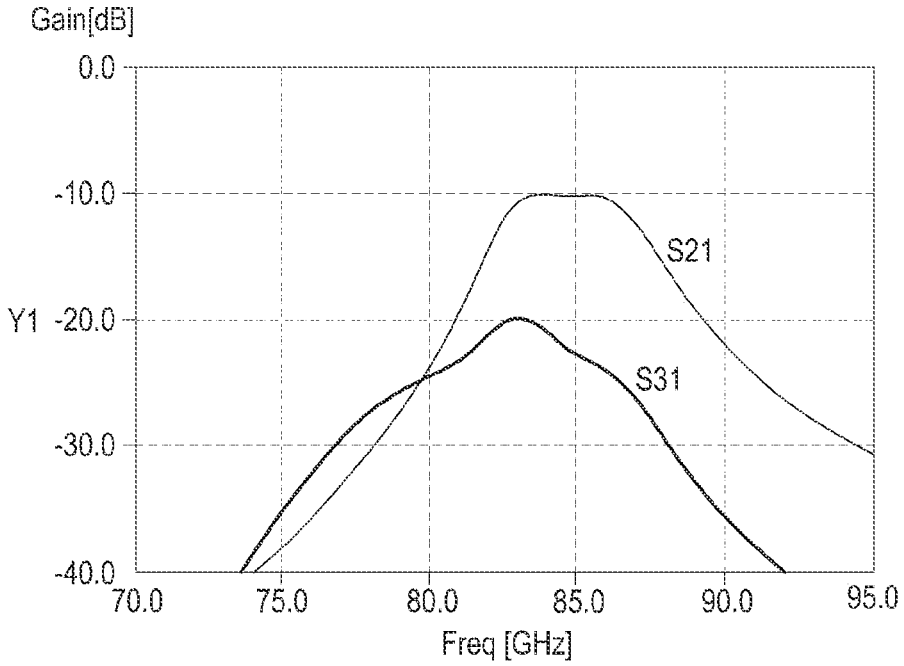
FIGS. 17 and 18 are graphs illustrating operation characteristics of an antenna device in an electronic device illustrated in FIG. 15 according to an embodiment of the present invention.
Figure 18:
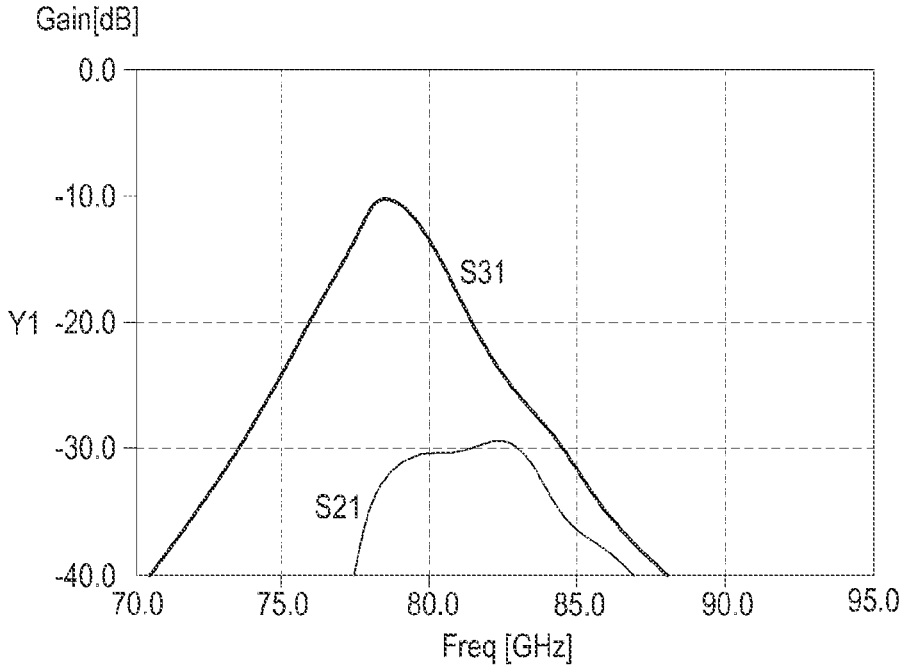

Referring to FIG. 15, in the electronic device 10, a distance D1 between the first antenna device 100*a* and the second antenna device 100*b* and a distance D2 between the first antenna device 100*a* and the third antenna device 100*c* are both set to be 1 mm, and the amount of signal transmission and reception is measured and illustrated in FIGS. 17 and 18. In FIGS. 17 and 18, S21 indicates the amount of signal transmission and reception between the first antenna device 100*a* and the second antenna device 100*b*, and S31 indicates the amount of signal transmission and reception between the first antenna device 100*a* and the third antenna device 100*c*.

FIG. 17 is a graph illustrating the amount of signal transmission and reception among the antenna devices 100*a*, 100*b*, and 100*c* when 180° out-of-phase feeding is provided to the first feed point 121 and the second feed point 123 of the first antenna device 100*a*. When 180° out-of-phase feeding is provided to the first feed point 121 and the second feed point 123 of the first antenna device 100*a*, the first antenna device 100*a* forms a broadside radiation pattern. In this case, the first antenna device 100*a* and the second antenna device 100*b* may perform transmission and reception while isolating by a gain value about 10 dB from the third antenna device 100*c* in a frequency about 85 GHz.

FIG. 18 is a graph illustrating the amount of signal transmission and reception among the antenna devices 100*a*, 100*b*, and 100*c* when in-phase feeding is provided to the first feed point 121 and the second feed point 123 of the first antenna device 100*a*. When in-phase feeding is provided to the first feed point 121 and the second feed point 123 of the first antenna device 100*a*, the first antenna device 100*a* forms an endfire radiation pattern. In this case, the first antenna device 100*a* and the third antenna device 100*c* may perform transmission and reception while isolating by a gain value about 20 dB from the second antenna device 100*b* in a frequency about 78 GHz.

As such, an antenna device may provide a sufficient isolation from another antenna device so that another antenna does not directly involve transmission and reception, even in a small space such as an internal space in an electronic device. In other words, the antenna device may select one of adjacent other antenna devices and communicate with the selected antenna device while minimizing an influence on the other antenna devices that do not engage in transmission and reception.

Generally, in a patch antenna structure, a feed point is provided in the center of a radiation patch in the x-axis direction (or the y-axis direction) and a feed point is provided at a side of the radiation patch in the y-axis direction (or the x-axis direction). In the antenna device 100 illustrated in FIG. 1, feed points are provided in the center of the radiation patch 102 in the x-axis direction and feed points are provided at both sides with respect to the center of the radiation patch 102 in the y-axis direction. However, in another embodiment of the present invention, the first feed point 121 and the second feed point 123 may be disposed at positions offset from the center of the radiation patch 102 in the x-axis direction and in the y-axis direction.

Figure 19:
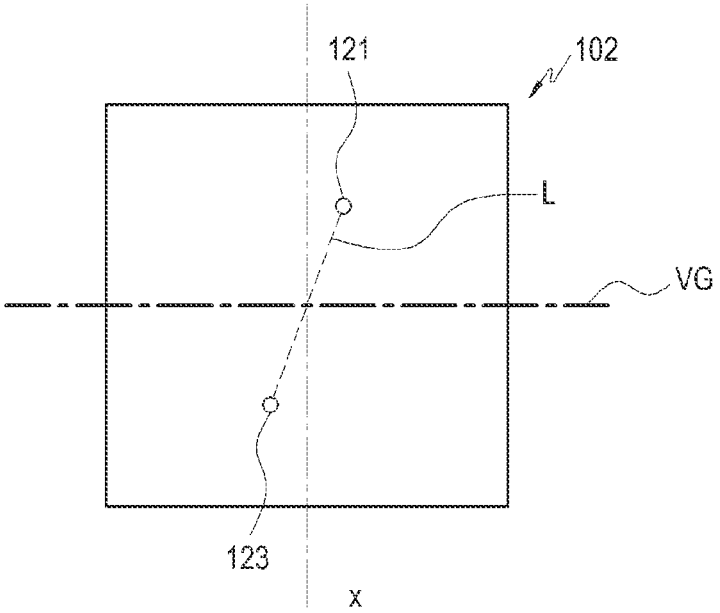
FIGS. 19 and 20 are floor planes illustrating an antenna device according to another embodiment of the present invention.
Figure 20:
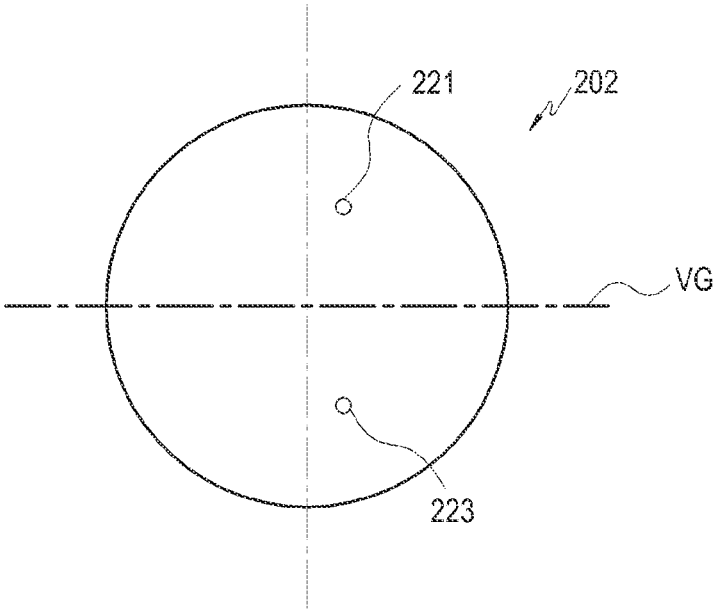

FIGS. 19 and 20 illustrate radiation patches 102 and 202 of an antenna device according to another embodiment of the present invention. FIG. 19 illustrates the square radiation patch 102, the length of one side of which is a half of a resonance frequency wavelength, and FIG. 20 illustrates the circular radiation patch 202 whose diameter is a half of a resonance frequency wavelength. Each of first and second feed points 121 and 123 (221 and 223) is in one of quadrants of each of the radiation patch 102 (202), and a quadrant in which the second feed point 123 (223) is positioned may be adjacent to a quadrant in which the first feed point 121 (221) is positioned. Also, the straight line L connecting the first feed point 121 (221) with the second feed point 123 (223) on the radiation patch 102 (202) may be inclined with respect to the VG plane. FIG. illustrates the first feed point 121 and the second feed point 123 are positioned in quadrants that are diagonal to each other, and thus they are at positions offset from each other in the x-axis direction or in the y-axis direction.

Thus, by disposing the first feed point 121 (221) and the second feed point (223) at positions offset from the center of the radiation patch 102 (202), the broadside radiation pattern or the endfire radiation pattern may be steered.

As is apparent from the foregoing description, an antenna device according to the above-described embodiments of the present invention may easily form the broadside radiation pattern and the endfire radiation pattern in spite of using just one radiation patch. By implementing a pattern diversity function with the one radiation patch, miniaturization is made easy and ultra-high speed and voluminous transmission and reception may be implemented. Moreover, even when the antenna device performs transmission and reception with an adjacent second antenna device, the antenna device forms a high isolation from an adjacent third antenna device, thereby providing a stable data transmission line when installed in a small space, for example, in an electronic device. For example, an antenna device as described above may be installed in an electronic device and may be used for transmission of voluminous data like high-definition video information. Thus, by using an antenna device in accordance with an embodiment of the present invention, a wireless transmission line may be formed between a chip mounted thereon a codec for video playback and a display module. Therefore, the antenna device may be easily disposed in a limited space such as in an electronic device and at the same time, may provide an ultra-high speed and large-capacity transmission line.

While the present invention has been particularly shown and described with reference to various embodiments thereof, various changes in form and detail may be made therein without departing from the spirit and scope of the present invention as defined by the following claims. Accordingly, the scope of the present invention will be defined by the appended claims and any equivalents thereto.

What is claimed is:

1. An antenna device comprising:

a radiation patch configured in a shape of a flat plate;

a first feed point configured in a side region of the radiation patch; and a second feed point configured in another side region of the radiation patch, wherein the first feed point and the second feed point are configured a same distance from a virtual ground plane formed on the radiation patch, wherein out-of-phase feeding is provided to the first feed point and the second feed point to form a broadside radiation pattern, and wherein in-phase feeding is provided to the first feed point and the second feed point to form an endfire radiation pattern.

2. The antenna device of claim 1, wherein the first feed point is configured in a first quadrant of the radiation patch, and the second feed point is configured in a second quadrant of the radiation patch.

3. The antenna device of claim 2, wherein the first quadrant configured and the second quadrant are adjacent to each other.

4. The antenna device of claim 1, wherein the radiation patch is in a circular shape having a diameter that is a half of a resonance frequency wavelength.

5. The antenna device of claim 1, wherein the radiation patch is in a quadrangular shape, one side of which has a length that is a half of a resonance frequency wavelength.

6. The antenna device of claim 1, wherein the broadside radiation pattern is steered according to a phase difference of the out-of-phase feeding provided to the first feed point and the second feed point.

7. The antenna device of claim 1, further comprising:

a first phase shifter connected to the first feed point; and a second phase shifter connected to the second feed point.

8. The antenna device of claim 1, further comprising:

a dielectric substrate on which the radiation patch is mounted;

a ground plane configured on the dielectric substrate; and a connection member configured to connect the radiation patch to the ground plane, wherein the connection member is connected to the radiation patch between the first feed point and the second feed point to steer the endfire radiation pattern.

9. The antenna device of claim 8, wherein the connection member is configured a same distance from the first feed point and the second feed point.

10. The antenna device of claim 8, wherein the connection member comprises a via-hole formed in the dielectric substrate.

11. The antenna device of claim 8, wherein the connection member comprises a metallic rod extending from the radiation patch to the ground plane.

12. The antenna device of claim 1, wherein the first feed point and the second feed point are disposed symmetrically with respect to the virtual ground plane on the radiation patch.

13. An electronic device comprising:

a first circuit board;

a first antenna device configured on the first circuit board;

a second circuit board configured to face the first circuit board; and a second antenna device configured on the second circuit board, wherein the first antenna device comprises a radiation patch in a shape of a flat plate, a first feed point configured in a side region of the radiation patch, and a second feed point configured in another side region of the radiation patch, wherein the first feed point and the second feed point are configured a same distance from a virtual ground plane formed on the radiation patch, wherein out-of-phase feeding is provided to the first feed point and the second feed point to form a broadside radiation pattern, and wherein in-phase feeding is provided to the first feed point and the second feed point to form an endfire radiation pattern.

14. The electronic device of claim 13, wherein the second circuit board is provided on a touch screen display panel.

15. The electronic device of claim 13, wherein the radiation patch is disposed to face the second antenna device, and when 180° out-of-phase feeding is provided to the first feed point and the second feed point, the first antenna device and the second antenna device perform transmission and reception to each other.

16. The electronic device of claim 13, further comprising a third antenna device configured on the first circuit board, adjacent to the first antenna device, wherein the first antenna device relays a wireless signal between the second antenna device and the third antenna device.

17. The electronic device of claim 16, wherein when the in-phase feeding is provided to the first feed point and the second feed point, the first antenna device and the third antenna device perform transmission and reception to each other.

18. The electronic device of claim 13, wherein the first feed point and the second feed point are disposed symmetrically with respect to the virtual ground plane on the radiation patch.

* * * * *